US006460695B2

(12) United States Patent
Gursky, Sr. et al.

(10) Patent No.: US 6,460,695 B2
(45) **Date of Patent: *Oct. 8, 2002**

(54) ANTI-THEFT DISPLAY BOX OF A CONSUMER ARTICLE

(75) Inventors: Richard W. Gursky, Sr., Oakville, CT (US); Gerald Dimarco, Poughkeepsie, NY (US)

(73) Assignee: Timex Group B.V. (NL)

( * ) Notice: Subject to any disclaimer, the term of this patent is extended or adjusted under 35 U.S.C. 154(b) by 0 days.

This patent is subject to a terminal disclaimer.

(21) Appl. No.: 09/897,289

(22) Filed: Jul. 2, 2001

(65) Prior Publication Data

US 2002/0005364 A1 Jan. 17, 2002

Related U.S. Application Data

(63) Continuation of application No. 09/408,775, filed on Sep. 29, 1999, now Pat. No. 6,257,399.

(51) Int. Cl.[7] ..... B65D 85/40
(52) U.S. Cl. ..... 206/18; 206/301
(58) Field of Search ..... 206/6.1, 18, 301, 206/764, 765, 771

(56) References Cited

U.S. PATENT DOCUMENTS 5,810,165 A * 9/1998 Lai ..... 206/18
6,257,399 B1 * 7/2001 Gursky, Sr. et al. ..... 206/301

* cited by examiner

*Primary Examiner*—David T. Fidel
(74) *Attorney, Agent, or Firm*—Carmody & Torrance LLP

(57) ABSTRACT

A display box for a consumer article is presented that includes a base, a support member and a cover. The base has at least one platform that includes an outer surface, a bottom surface, and a flange extending from the at least one platform. The base further includes an opening in the bottom surface defined by edges of the flange. The support member is adapted for supporting the consumer article and has a pedestal that is selectively mountable on and decoupleable from the flange. The cover has a top wall and four side walls that define an inner surface. The cover is selectively coupled to and decoupled from the base and can be positioned in a first position, in which the outer surface of the base and the inner surface of the four side walls cooperate to seal the display box and to prevent an unauthorized decoupling of the cover (i.e. opening of the display. box). Preferably, mechanical assistance is required to separate the cover and the base. In one embodiment, the pedestal includes a cavity for receiving a security device such as an EAS marker. In this embodiment, the cavity of the platform is aligned with the opening through the base such that when the cover is in the first, closed position, the security device may be affixed within the cavity.

5 Claims, 4 Drawing Sheets

ANTI-THEFT DISPLAY BOX OF A CONSUMER ARTICLE

CROSS REFERENCE TO RELATED APPLICATIONS

This application is a continuation of U.S. application Ser. No. 09/408,775, filed Sep. 29, 1999 now U.S. Pat. No. 6,257,399.

FIELD OF THE INVENTION

The present invention relates generally to display boxes for protecting consumer articles from theft, and more particularly, to an improved construction of a display box for securely storing and displaying consumer articles such as timepieces.

BACKGROUND OF THE INVENTION

It is well known to provide a package or display box for storing a consumer article during shipping and for exhibiting the article for sale in retail sales establishments. Typically, a retail sales establishment will exhibit the consumer article such as a timepiece in its individual display box on a rack or, alternatively, may arrange the display box on a counter top so that timepiece may be seen by a prospective purchaser. Such counter top exhibitions may include the timepiece within its display box or removed therefrom. To permit the exhibition of the timepiece within the display box, the display box typically has a cover that includes transparent portions.

In order to permit a closer inspection of the timepiece, the timepiece may be removed from the display box and arranged for exhibition on, for example, a counter top. That is, the timepiece and a C-shaped member of the display box may be removed from an interior cavity of the display box and utilized as a stand alone display. The C-shaped member, generally referred to as a C-clip, is adapted to support the timepiece thereon. This manner of exhibition enables a potential purchaser to pick up and examine the timepiece to assist in their purchasing decision but, however, also increases the likelihood that the timepiece may be stolen.

To deter theft of consumer articles such as timepieces, it is well known to provide surveillance systems that include, for example, scanners which establish an electromagnetic or magnetic field at entrances and exits of the retail sales establishment. In this respect, reference is made to U.S. Pat. No. 5,608,379, issued Mar. 4, 1997, entitled "Deactivatable EAS Tag," by Narlow et al. As described in Narlow et al. an electronic article surveillance (EAS) marker or tag may be attached to, for example, the display box or to the timepiece within the display box. When activated, the EAS marker interacts with the electromagnetic or magnetic field to indicate that the tagged article is entering the field. In this way, the presence of an active EAS marker activates an alarm indicating that a display box, i.e. a timepiece, containing an active EAS marker, is being removed from the premises.

The foregoing systems have been somewhat successful in deterring theft. However, in some conventional display box configurations an EAS marker may easily be removed to defeat the surveillance system. Further, certain merchandise such as, for example, timepieces have heretofore not be able to be tagged with an EAS marker in a manner which ensures the ability to pick up and examine the timepiece while simultaneously reducing the likelihood of theft of the timepiece. Thus, one perceived deficiency in prior art display box arrangements is an inability to reliably secure an EAS marker to the display box in a manner that permits exhibition of the timepiece while the timepiece is either within the display box or removed from the box.

Accordingly, the present invention provides an improved construction for securely storing and displaying a consumer article such as a timepiece and for reliably affixing a security device such as, for example, an EAS marker to reduce the likelihood of theft.

OBJECTS AND ADVANTAGES OF THE INVENTION

Therefore, it is an object and advantage of this invention to provide an improved arrangement for reducing or eliminating the theft of a consumer article, such as a timepiece.

It is another object and advantage of this invention to provide a consumer article display box for securely storing and displaying a consumer article.

Further objects and advantages of this invention will become more apparent from a consideration of the drawings and ensuing description.

SUMMARY OF THE INVENTION

The foregoing and other problems are overcome and the objects and advantages are realized by an apparatus, constructed in accordance with embodiments of this invention, wherein an improved arrangement for a consumer article display box is disclosed.

Generally speaking, the present invention comprises a display box for a consumer article that includes a base, a support member and a cover. The base has at least one platform that includes an outer surface, a bottom surface, and a flange extending from the at least one platform. The base further includes an opening in the bottom surface defined by edges of the flange. The support member is adapted for supporting the consumer article and has a pedestal that is selectively mountable to and decoupleable from the flange. The cover has a top wall and four side walls that define an inner surface. The cover is selectively coupled to and decoupled from the base and can be positioned in a first position, in which the outer surface of the base and the inner surface of the four side walls cooperate to seal the display box and to prevent an unauthorized decoupling of the cover (i.e. opening of the display box). Preferably, mechanical assistance is required to separate the cover and the base.

In one embodiment, the pedestal includes a cavity for receiving a security device such as, for example, an EAS marker. In this embodiment, the cavity of the platform is aligned with the opening through the base such that when the cover is in the first, closed position, the security device may be affixed within the cavity.

In another embodiment, the display box also includes a device for securely coupling the support member to the flange. For example, the device includes at least two tabs that extend from the at least one platform of the base. The tabs releaseably engage the pedestal of the support member to securely couple the support member onto the flange of the base.

BRIEF DESCRIPTION OF THE DRAWINGS

The above set forth and other features of the invention are made more apparent in the ensuing Detailed Description of the Preferred Embodiments when read in conjunction with the attached Drawings, wherein.

Identically labeled elements appearing in different ones of the above-described figures refer to the same elements but may not be referenced in the description for all figures.

DETAILED DESCRIPTION OF THE PREFERRED EMBODIMENTS

Figure 1:
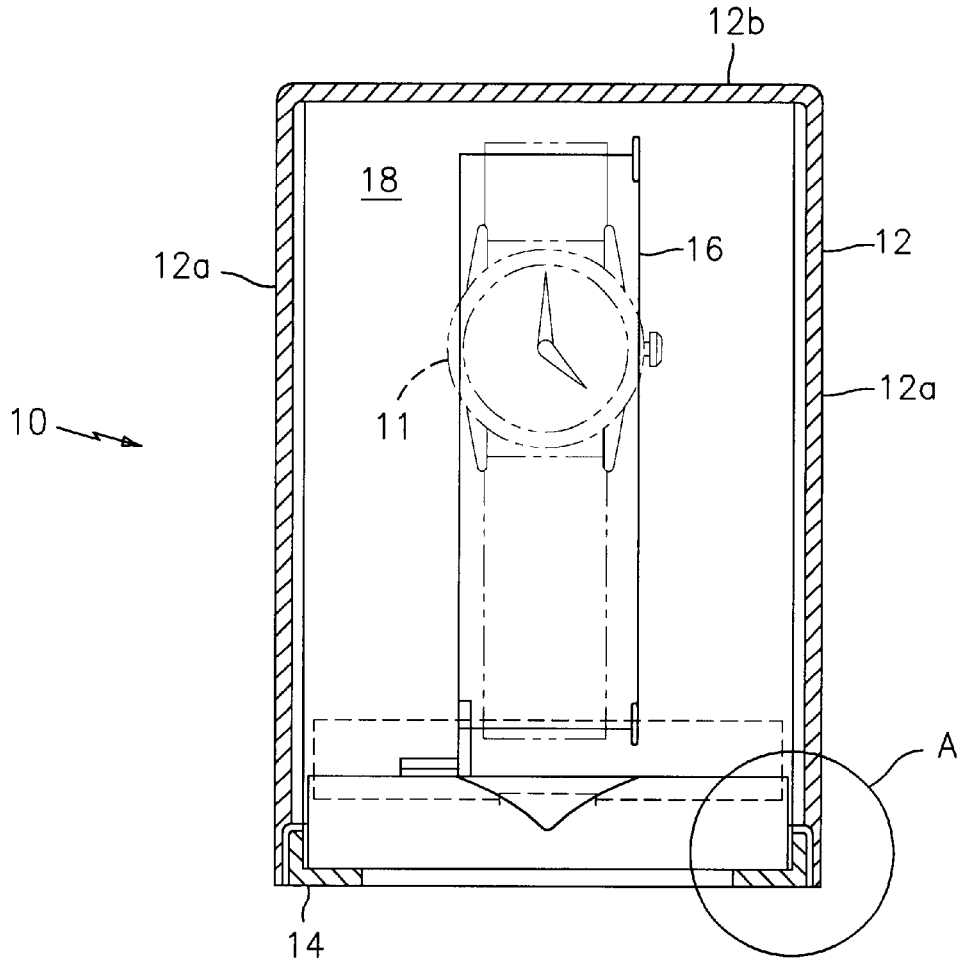
FIG. 1 is a front, elevational view of a display box constructed in accordance with the present invention and adapted to hold a timepiece.

FIG. 1 illustrates a display box, shown generally at 10, for a consumer article 11 configured in accordance with the present invention. The display box 10 includes a cover 12, a base 14 and a support member 16 for supporting the consumer article 11 such as, for example, a timepiece.

As shown in FIG. 1, and described in further detail below, the support member 16, generally referred to as a C-clip, mates with the base 14. As such, the base 14 and C-clip 16 may be selectively coupled as an assembly or uncoupled as individual components of the display box 10. As is also illustrated in FIG. 1, the base 14 and C-clip 16 assembly may be enclosed by the cover 12. That is, side walls 12*a* and a top wall 12*b* of the cover 12 define an interior chamber 18. The cover 12 is positionable for substantially enclosing the base 14 and C-clip 16 assembly within the interior chamber 11.

Figure 2:
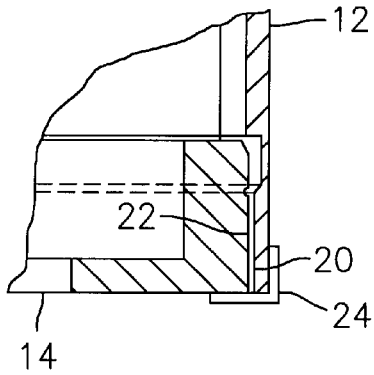
FIG. 2 is an enlarged, partial cross-sectional view along Line A which illustrates a cover of the display box engaging a base of the display box.

In accordance with the present invention, and as shown in FIG. 2, the side walls 12*a* of the cover 12 have an inner surface 20 while the base 14 has an outer surface 22. It should be appreciated that the C-clip 16 has been omitted from FIG. 2 to more clearly illustrate the engagement of the cover 12 and the base 14.

When in the enclosed position, the mating of the inner surface 20 of the cover 12 and the outer surface 22 of the base 14 seal the interior chamber 18. Once sealed, an accidental separation of the cover 12 and the base 14 is substantially prevented and, preferably, mechanical assistance is required to separate the cover 12 and the base 14. It follows therefore, that a secure storage area is provided for the consumer article 11, which rests upon the C-clip 16 within the interior chamber 18. In one embodiment, an adhesive material such as, for example, an adhesive tape 24 is affixed to portions of the cover 12 and the base 14 to assist in securing the seal.

Preferably, the side walls 12*a* and the top wall 12*b* are comprised of a transparent material such as, for example a polystyrene material of sufficient hardness to resist splintering. In one embodiment, the polystyrene material is comprised of Denka MW-1. With a cover comprised of transparent material, the secured storage container described above is also a secured display container. That is, when sealed the contents of the interior chamber 18, e.g. the consumer article 11, is still visible. Therefore, the secured storage container may serve a dual purpose as a secured display box. Alternatively, it should be appreciated that the C-clip 16 and the consumer article 11 may be removed from the interior chamber 18 and decoupled from the base 14 such that the C-clip 16 and the consumer article 11 may represent a stand alone display. Aspects of this feature of the present invention are discussed in further detail below.

Figure 3A:
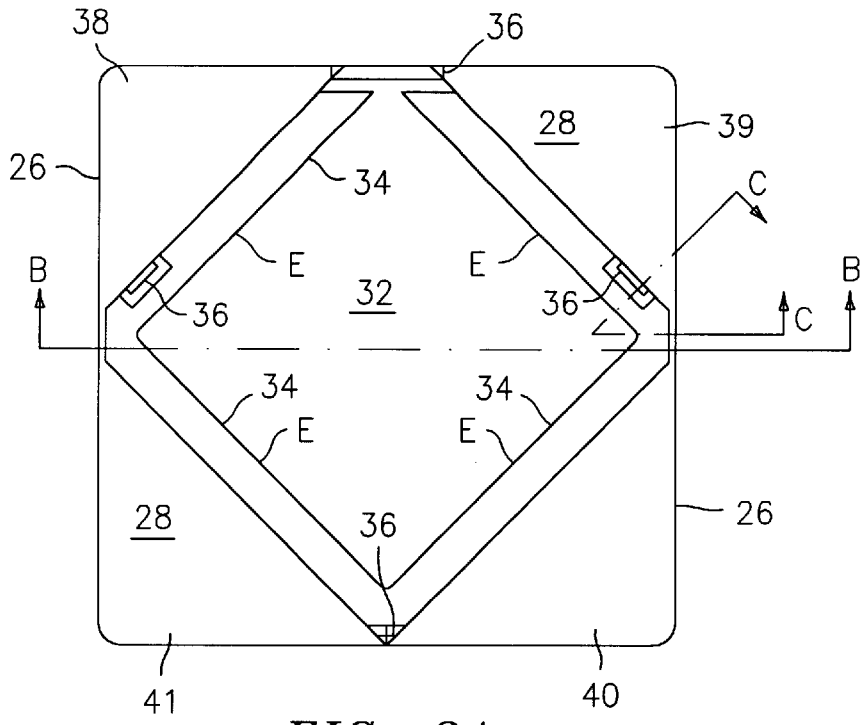
FIG. 3A is a top plan view of the base of the display box constructed in accordance with the present invention.
Figure 3B:
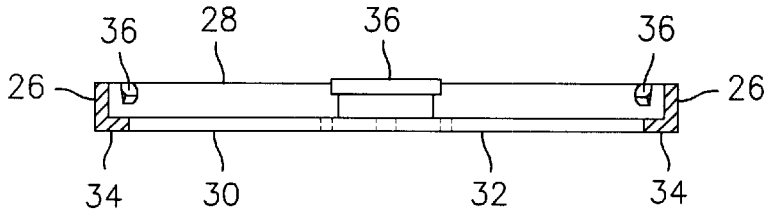
FIG. 3B is a side, elevational view in partial cross-section of the base taken along Line B—B which illustrates one configuration of the base.
Figure 3C:
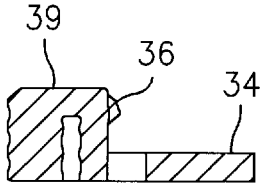
FIG. 3C. is an enlarged, partial cross-sectional view along Line C which illustrates a tab for locking a C-clip member into the base of the display box.

Referring now to FIGS. 3A–3C details of a preferred construction of the base 14 are illustrated. As shown in FIGS. 3A and 3B, the base 14 includes four essentially triangular platforms 38, 39, 40 and 41 all having an outer surface 26, a top surface 28 and a bottom surface 30. It should be understood that portions of the platforms 38–41 could all be integrally formed so as to create one platform with four sections. The present verbiage is used for the convenience of the reader as one skilled in the art would appreciate the various potential configurations.

In accordance with the present invention, the bottom surfaces 30 of the platforms 38–41 continuously extend inwardly from the outer surfaces 26 towards the center of the base 14 so as to form a flange 34 extending from each of the platforms 38–41. The flange 34 is coplanar with the bottom surfaces 30 and receives a bottom surface 42 of the C-clip 16 (FIG. 4B). An interior bottom surface of the base 14 bordered by an edge E of the flange 34 has been removed so as to define an opening 32. The flange 34 is dimensioned slightly larger than the bottom surface 42 of the C-clip 16 so as to accept the C-clip 16 thereon. In one embodiment, the flange 34 and the bottom surface 42 of the C-clip 16 are diamond-shaped (FIGS. 3A and 4A).

Figure 5:
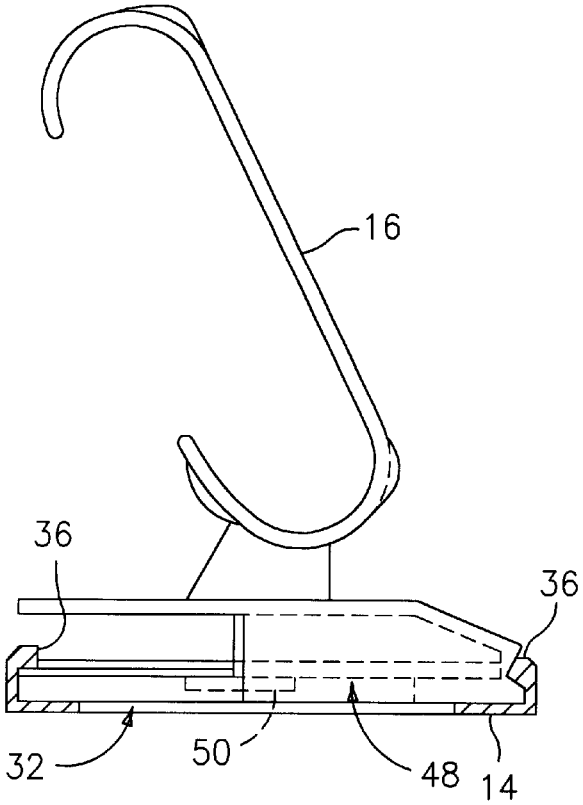
FIG. 5 is a side, elevational view in partial cross-section which illustrates a locking engagement of the base and the C-clip member of the display box.

Preferably, at least two tabs, for example tabs 36, extend from and are integrally formed with two of the platforms 38–41. The tabs 36 extend over the flange 34 from a respective one of the platforms 38–41. The tabs 36, shown in detail at FIGS. 3C and 5, engage the C-clip 16 when it is disposed on the flange 34 to securely couple the C-clip 16 thereon. As should be appreciated, the tabs 36 may be disengaged to release the C-clip 16. As shown in FIG. 5, the tabs 36 "lock" the C-clip 16 to firmly seat the C-clip 16 on the flange 34 of the base 14 so that if the base 14 and/or display box 10 is inverted, the C-clip 16, and more appropriately the consumer article 11, remains securely seated within the base 14.

Figure 4A:
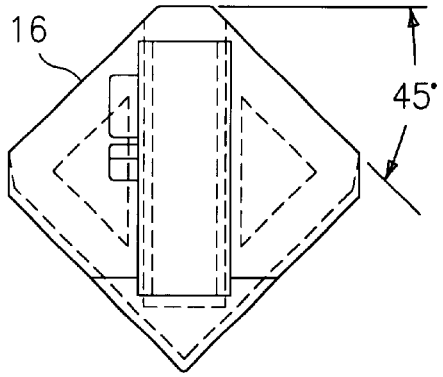
FIG. 4A is a top plan view of the C-clip member of the display box constructed in accordance with the present invention.
Figure 4B:
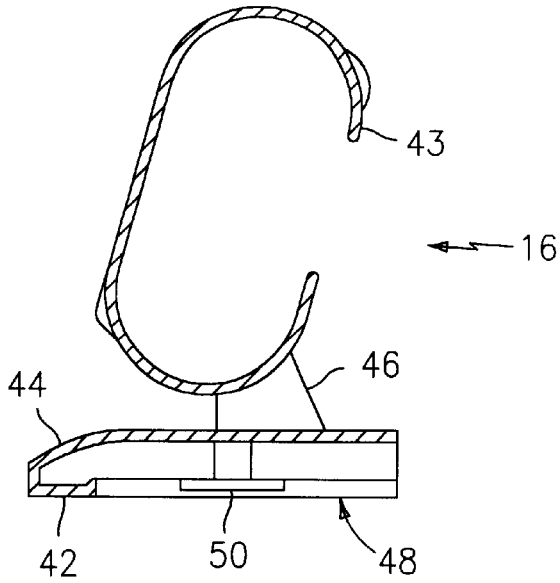
FIG. 4B is a side, elevational view in partial cross-section of the C-clip of FIG. 4A.

Referring now to FIGS. 4A and 4B details of a preferred construction of the support member 16 are illustrated. As shown in FIGS. 4A and 4B, the C-clip 16 includes a flexible C-shaped member 43 that is affixed to a pedestal 44 by an integral rib 46. As discussed above, the consumer article 11, e.g. a timepiece, is mounted on the flexible C-shaped member 43 such that, for example, a strap of the timepiece encircles the C-shaped member 43.

In accordance with the present invention, the pedestal 44 is configured to mate on the flange 34 of the base 14. Thus, the pedestal 44 has similar although smaller dimensions as the areas defined by the flange 34 and the spacing of the platforms 38–41. As such, the pedestal 44 (i.e. the C-clip 16) may be coupled to and decoupled from the base 14. As is apparent from FIGS. 3A and 4A, in one embodiment of the present invention, the flange 34 and the pedestal 44 are diamond-shaped.

Figure 6:
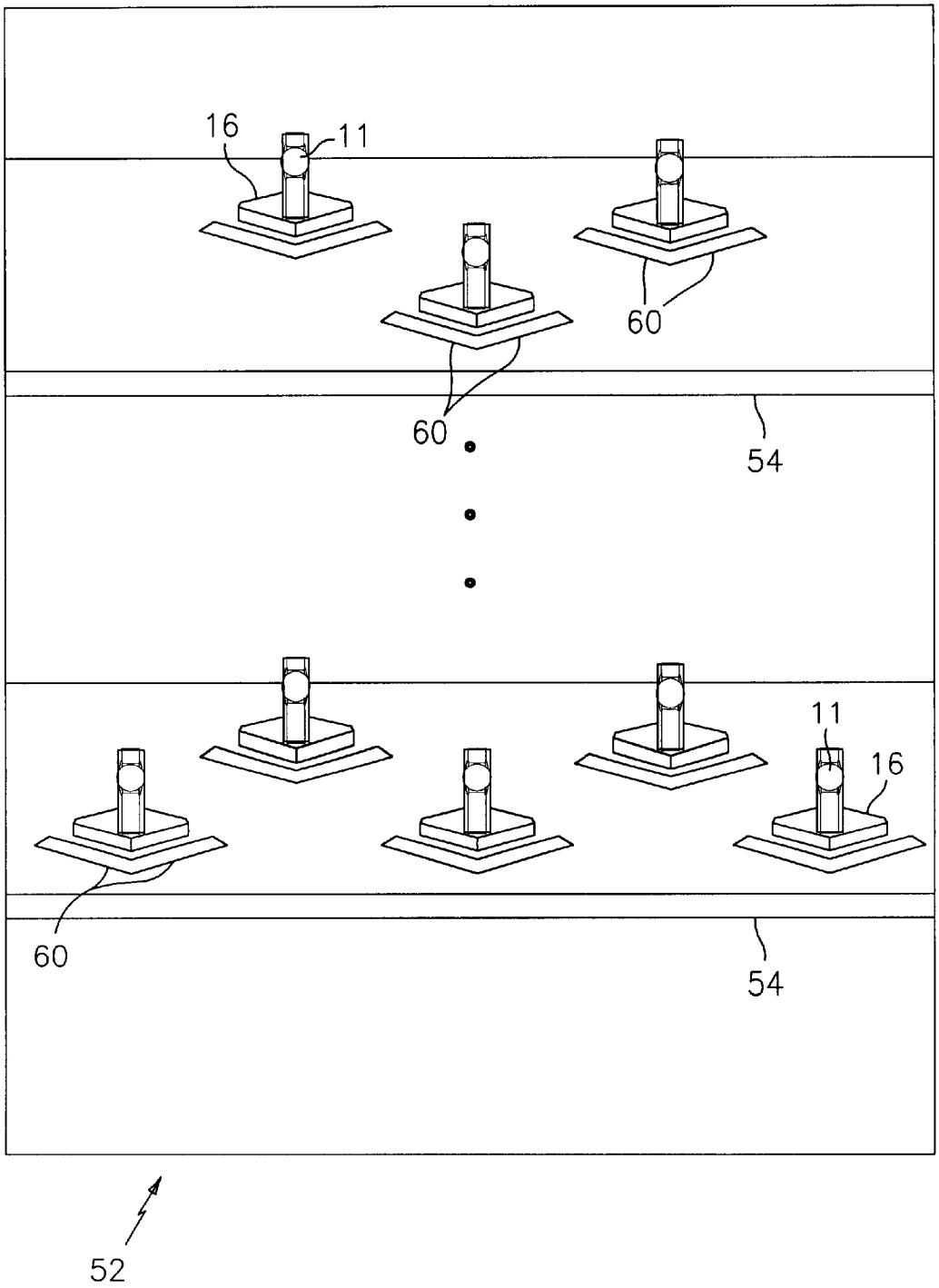
FIG. 6 is a front elevational view of a display stand constructed in accordance with the present invention and adapted for engaging a base of a display box.

As discussed briefly above, the C-clip 16 and the consumer article 11 supported thereon may be exhibited on a counter top as a stand alone display such as, for example, in the display box 10. In another aspect of the present invention, illustrated in FIG. 6, the C-clip 16 and the consumer article 11 may be exhibited on a display stand or rack 52 having shelves 54 with rails 60 configured to mate with the configuration of the bottom surface 42 of the C-clip 16 (FIGS. 4A and 4B). For example, in one embodiment, the shelves 54 may include integrally molded rails 60 that correspond to the shape of the configuration of the bottom surface 42 of the C-clip 16. In this way, the C-clip 16 may be inserted between rails 60 on shelf 54 to support C-clip 16. Additional rails 60 may be added to the extent that they provide support for the bottom surface 42 and C-clip 16 generally. In this way, a uniquely configured combination individual display stand and shelving unit can be configured to facilitate the display of the consumer article 11 within the display box 10 when it is desired to have the consumer article 11 sufficiently protected from theft thereof as disclosed above, yet also have a correspondingly designed shelving display to permit the consumer article 11 and C-clip 16 to be individually displayed outside the box 10 and be more accessible to a potential consumer. Heretofore no combination display box and shelving display has been described wherein the configuration of the shelving display, such as by using rails 60, has corresponded with the shape of the display box 10 and the configuration of the bottom surface 42 of C-clip 16 in particular so as to permit the display of the consumer article 11 in a multitude of manners. It should be appreciated that the bottom surface 42 of the C-clip 16 need not be diamond shape, but for the present embodiment, it is only necessary that the configuration, shape and angles of rails 60 correspond to the shape of the bottom surface 42.

In another aspect of the present invention, the bottom surface 42 of the pedestal 44 preferably includes a chamber 48 for receiving an electronic article surveillance (EAS) marker or tag 50. As noted in the Background Section, the EAS tag 50 is a known device for providing traceability or surveillance of consumer articles to minimize theft. When affixed within the chamber 48 of the pedestal 44, the EAS tag 50 provides traceability for the consumer article 11 mounted on the C-shaped member 43.

Referring again to FIG. 5, the C-clip 16 is shown assembled on the flange 34 of the base 14 with the tabs 36 releaseably securing the pedestal 44 thereto. The opening 32 of the base 14 and the chamber 48 of the C-clip 16 are aligned such that the EAS tag 50 may be affixed within the chamber 48 as the C-clip 16 and the base 14 are in the assembled configuration. It should be appreciated that even when the cover 12 encloses the base 14 and the C-clip 16, the EAS tag 50 may be affixed within the chamber 48 by passing the tag 50 through the opening 32 in the base 14 and into the chamber 48.

In accordance with the present invention, by affixing the EAS tag 50 within the chamber 48 of the base 14 traceability is provided when the consumer article 11 is exhibited within the display box 10 (i.e. in the assembled configuration wherein the C-clip 16 is disposed on the flange 34 of the base 14, and the base 14, C-clip 16 and consumer article 11 are enclosed by the cover 12) or when the consumer article 11 is exhibited on the C-clip 16 as a stand alone display.

In one embodiment, a sheet material or label may be affixed to the bottom surface 42 of the C-clip 16 after the EAS tag 50 has been disposed in the chamber 48. By concealing the presence of the EAS tag 50 from visual detection, an attempt to locate and to remove the tag 50 may be defeated. A suitable EAS tag 50 for use in the present invention may be an electronic article surveillance label such as an ULTRASTRIP™ Label produced by the Sensormatic Electronic Corporation of Hollywood, Fla.

Although described in the context of preferred embodiments, it should be realized that a number of modifications to these teachings may occur to one skilled in the art. As should be appreciated, the scope of the present invention is not limited to a particular configuration of the base 14, the triangular platforms 38–41 or the pedestal 44, nor is the present invention solely for use as a display box for timepieces as use with other consumer articles is contemplated hereby.

While the invention has been particularly shown and described with respect to preferred embodiments thereof, it will be understood by those skilled in the art that changes in form and details may be made therein without departing from the scope and spirit of the invention.

What is claimed is:

1. A display box for a consumer article comprising:

a base having at least one platform having an outer surface, a bottom surface and a flange extending therefrom, wherein the base further includes an opening defined by edges of the flange;

a support member for supporting the consumer article and having a pedestal mountable on the flange;

a cover having a top wall and side walls having an inner surface, the cover being coupleable to the base and positionable in a first position wherein the outer.surface of the base and the inner surface of the side walls cooperate to seal the display box and to prevent an unauthorized decoupling thereof; and wherein the pedestal includes a cavity defined therein for receiving an electronic security device and wherein the cavity of the pedestal is aligned with the opening of the base such that when the cover is in the first position, the electronic security device may be affixed within the cavity of the pedestal.

2. The display box as set forth in claim 1, wherein the top wall and the side walls are comprised of a transparent material.

3. The display box as set forth in claim 1, further including securing means for securely coupling the support member on the flange of the base.

4. The display box as set forth in claim 1, including at least two tabs extending from the at least one platform for releaseably engaging the pedestal of the support member.

5. A display box for a consumer article, comprising:

a base including at least one platform having an outer surface, a bottom surface having an opening therethrough, and a flange;

a support member for supporting the consumer article and having a pedestal mountable on the flange wherein the pedestal includes a cavity defined therein for receiving an electronic security device;

a cover having a top wall and side walls having an inner surface, the cover being coupleable to the base and positionable in a first position wherein the outer surface of the base and the inner surface of the side walls cooperate to seal the display box and to prevent an unauthorized decoupling thereof; and wherein the cavity of the pedestal is aligned with the opening of the base such that when the cover is in the first position, the electronic security device may be affixed within the cavity of the pedestal.

* * * * *